United States Patent [19]

Beck

[11] 4,159,772

[45] Jul. 3, 1979

[54] TREATED PAD DISPENSING DEVICE

[75] Inventor: Harold Beck, Wantagh, N.Y.

[73] Assignee: Tissue Products Co., Inc., Bronx, N.Y.

[21] Appl. No.: 864,502

[22] Filed: Dec. 27, 1977

[51] Int. Cl.[2] ..... B65D 5/72

[52] U.S. Cl. ..... 206/820; 221/63

[58] Field of Search ..... 206/205, 233, 372, 390, 206/409, 445, 494, 620, 812, 820, 39.7–39.8; 221/33, 63; 225/106

[56] References Cited

U.S. PATENT DOCUMENTS

| | | | |
|---|---|---|---|
| 2,732,065 | 1/1956 | Marchese | 206/820 X |
| 2,776,787 | 1/1957 | Nicol | 206/820 X |
| 3,225,916 | 12/1965 | Field et al. | 206/820 X |
| 3,613,142 | 10/1971 | Chaney, Jr. | 206/820 X |

FOREIGN PATENT DOCUMENTS

| | | | |
|---|---|---|---|
| 2405793 | 9/1974 | Fed. Rep. of Germany | 221/63 |

*Primary Examiner*—Davis T. Moorhead

*Attorney, Agent, or Firm*—Howard C. Miskin

[57] ABSTRACT

A pad dispensing device includes a receptacle having a dispensing slot in its top wall and a stack of pads contained in the receptacle, the pads being interconnected by elongated pull tabs having transverse lines of weakness at their junctions with the leading pads. The stack of pads is formed of a continuous web including longitudinally spaced pads which may be circular or other shapes, successive pads being connected by intervening elongated tabs, and the web being accordian folded to superimpose the pads. The pads are impregnated with an active ingredient. The leading tab projects through the dispensing slot and as a pad is withdrawn the next pull tab is exposed.

7 Claims, 4 Drawing Figures

TREATED PAD DISPENSING DEVICE

BACKGROUND OF THE INVENTION

The present invention relates generally to improvements in dispensing devices and it relates more particularly to an improved device for dispensing individual active ingredient carrying pads from a stack or cartridge thereof.

A widely used article having many applications is a thin pad impregnated with an active ingredient. Such pads are commonly formed of an absorbent paper or fabric and are frequently wet. The pads are either individually packaged or a plurality thereof are packaged in a closed container and are individually extracted by opening the container and withdrawing one or more of the pads. The arrangements heretofore employed and proposed for dispensing active ingredient impregnated thin pads, particularly wet or moist pads possess numerous drawbacks and disadvantages. They are awkward and inconvenient to use, are of little versatility and adaptability, and otherwise leave much to be desired.

SUMMARY OF THE INVENTION

It is a principal object of the present invention to provide an improved package and dispensing device.

Another object of the present invention is to provide an improved device for dispensing individual pads from a contained store thereof.

Still another object of the present invention is to provide an improved device for packaging and dispensing individual active ingredient carrying pads from a contained storage thereof.

A further object of the present invention is to provide an improved device of the above nature characterized by its simplicity, reliability, low cost, ease and convenience of use and great versatility and adaptability.

The above and other objects of the present invention will become apparent from a reading of the following description taken in conjunction with the accompanying drawings which illustrate a preferred embodiment thereof.

In a sense, the present invention contemplates an improved pad dispensing device comprising a continuous web including longitudinally spaced pad defining enlarged sections, successive pads being interconnected by elongated pull tabs and said web being accordian folded with said pads being disposed in overlying positions. The pads carry an active ingredient and are preferably wet and lines of weakness are advantageously formed at the junction of each pull tab and the next leading or upper pad. The stacked superimposed pads are contained in a receptacle with a dispensing slot in a wall thereof and the leading pull tab projects through the dispensing slot to facilitate the withdrawal of the uppermost pad and the next trailing pull tab.

In the preferred form of the improved dispensing device, the pads are circular and are interconnected by elongated rectangular pull tabs. The receptacle includes an open topped cylindrical body in which the stack of superimposed pads are stored and a cap closing the receptacle top opening and having a dispensing slot through which the leading pull tab extends the slot being of a length at least equal to the diameter of the pads.

The improved pad dispensing device is highly reliable, inexpensive, of simple and rugged construction, easy and convenient to use and of great versatility and adaptability.

DESCRIPTION OF THE PREFERRED EMBODIMENT

Figure 1:
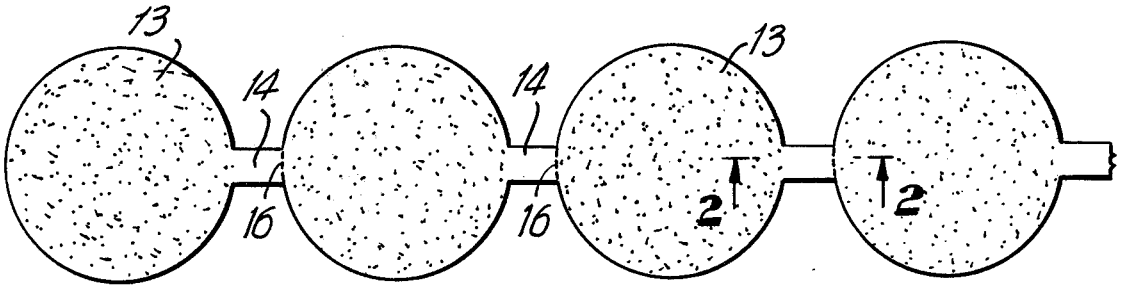
FIG. 1 is a fragmentary top plan view of a group of interconnected pads in accordance with the present invention shown in an unfolded lay flat condition.
Figure 2:
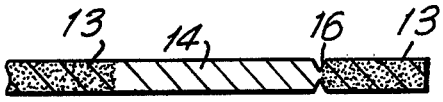
FIG. 2 is an enlarged sectional view taken along line 2—2 in FIG. 1.
Figure 3:
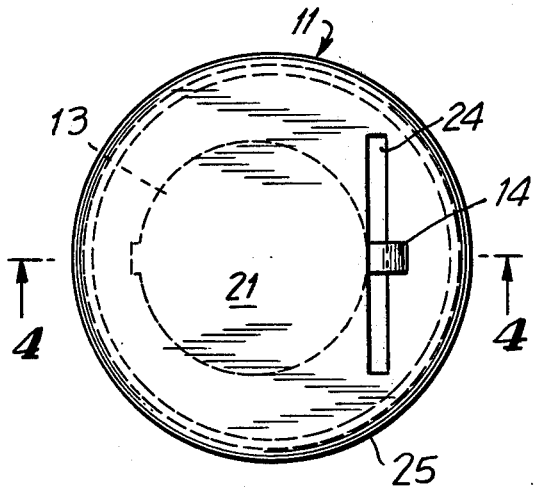
FIG. 3 is a top plan view of the assembled dispensing device of the present invention.
Figure 4:
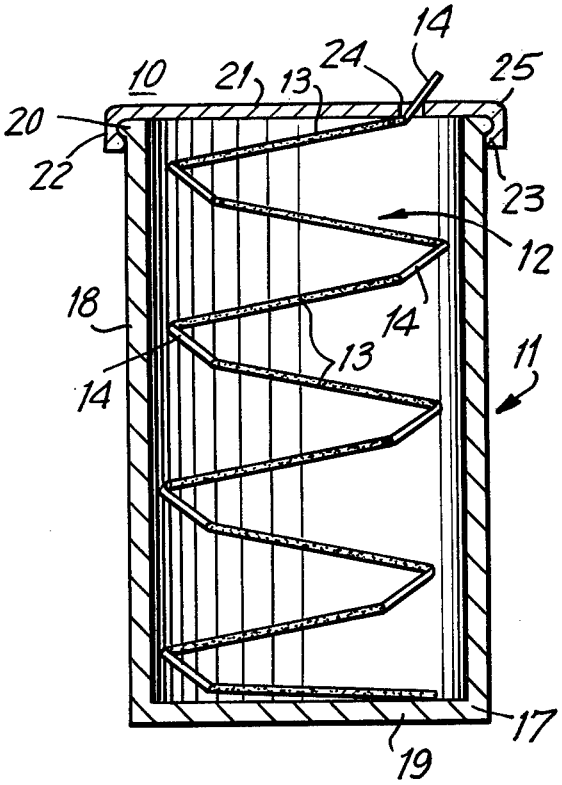
FIG. 4 is a sectional view taken along line 4—4 in FIG. 3.

Referring now to the drawings which illustrate a preferred embodiment of the present invention, the reference numeral 10 generally designates the improved dispensing device which comprises a receptacle 11 in which is replaceably housed a cartridge or stack 12 of pads 13. It should be noted that the device 10 is illustrated with the pads 13 of stack 12 being substantially depleted and hence extended, and that in the normal unused stack which is initially loaded in the receptacle 11 the pads are in contacting superimposition and successive pads are transversely offset as will be hereinafter explained.

The pads 13, while preferably of circular configuration, as illustrated, may be of other shapes; for example, polygonal or the like. The pads 13 are longitudinally spaced and successive pads are interconnected by elongated preferably rectangular pull tabs 14, each tab 14 being delineated from the next adjacent leading pad 13 by a line of weakness 16 along the junction of the respective tab 14 and pad 13. The lines of weakness may be perforated areas, areas of reduced thickness or the like.

The pads or enlarged sections 13 and pull tabs 14 are integrally formed in long lengths from corresponding webs and the lines of weakness 16 are simultaneously formed by any suitable manner, such as by die cutting, roller dies and other known methods. The material forming the web including pads 13 and pull tabs 14 may be of any suitable type and composition, and is advantageously water absorbent and formed of filaments or fibers such as paper, scrim reinforced paper, woven or non-woven fabric or the like. A long length of alternate pull tabs and pads are accordian folded about the lines of weakness 16 and formed into a stack of alternately offset pads interconnected by the tabs 14 disposed between borders of successive pads 13.

The pads 13 carry any desirable active ingredient which may coat or impregnate the pads and may be dispersed or dissolved in a fluid vehicle such as water or an organic solvent or the like. It is important to note that the pull tabs 14 are untreated and substantially free of the active ingredient or any of the fluid vehicle. Among the compositions which impregnate the pads 13 are detergents or other cleansing compositions, bactericides, medications of various types for topical applications, disinfectants, facial cream compositions and the like.

The receptacle 11 comprises a hollow cylindrical body 17 including a cylindrical peripheral wall 18 and a flat bottom end or base wall 19, the peripheral wall terminating at its top in an integrally formed outwardly projecting peripheral lip 20. The receptacle body member 17 is open at its top, the top opening being closed by a removable snap-on cap 25 including a flat circular top wall 21 and a depending integrally formed peripheral skirt wall 22 having in its upper inner border a peripheral groove, and at its lower border an inwardly directed integrally formed peripheral lip 23. Formed in the closure cap top wall 21 is a linear dispensing or discharge slot 24 of a length slightly greater than the diameter of pads 13 and being medially located in the cap top wall 21 and transversely offset from the center thereof a distance approximately equal to the radius of the pads 13. The receptacle peripheral wall lip 20 is tightly releasably entrapped between the confronting faces of the border of the cap top wall 21 and the cap lip 23. The receptacle body and cap are formed of any suitable material, advantageously a synthetic organic polymeric resin such as a polyolefin or the like. While the receptacle is shown as being of circular transverse cross-section it may be of other shape, depending on the size and shape of the pads 13 and the cap 25 may be otherwise coupled to the body member 17 such as by screw coupling, bayonet coupling or the like.

In the assembled condition of the dispensing device 10 the fresh stack 12 with the pads 13 being superimposed and alternately transversely offset is coaxially loaded in the receptacle 11 with the leading pull tab 14 extending from the leading edge of the topmost pad 13 projecting outwardly through dispensing slot 24 midway between its ends. It should be noted that in the stacked pads the tabs 14 are disposed between the borders of successive pads 13.

In the dispensing of an individual pad 13, the topmost pad 13 is withdrawn through the slot 24 by pulling on the exposed leading pull tab 14 until the pad is fully withdrawn and the next succeeding pull tab 14 is exposed. Thereafter, the withdrawn pad 13 is detached from the trailing pull tab 14 by pulling the withdrawn pad sideways by means of the leading tab to tear or sever the frangible line of weakness 16. It should be noted that the area of the line of weakness 16 is sufficiently strong to permit the longitudinal drawing of the next succeeding upper pad 13 from the stack 12 to the slot 24 without rupturing the line of weakness 16, but sufficiently weak to permit the easy tearing thereof along the length of the line of weakness 16. Successive individual pads 13 may be withdrawn and detached by repeating the above procedure. Upon the full depletion of the stack 12, a fresh stack may be loaded in the receptacle 11 by removing the closure cap 25 and thereafter replacing the closure cap 25 with the leading pull tab 14 projecting therethrough.

The improved dispensing device is simple, rugged and inexpensive, and is easy and convenient to use, individual pads being dispensable and detachable therefrom without any manual contact with the pads, per se.

While there has been described and illustrated a preferred embodiment of the present invention, it is apparent that numerous alterations, omissions and additions may be made without departing from the spirit thereof.

I claim:

1. A dispensing device comprising a stack of pads consisting essentially of a long substantially flat, unitary, fibrous web including longitudinally spaced enlarged sections impregnanted with an active ingredient and interconnected at their proximate edges by integrally formed relatively narrow pull tabs, said web being accordian folded along transverse lines proximate said pull tabs and said enlarged sections being superimprosed into said stack in which said impregnated enlarged sections are in face-to-face contact and with said pull tabs proximate the periphery of said stock.

2. The dispensing device of claim 1 wherein said pull tabs are substantially free of said active ingredient.

3. The dispensing device of claim 2 wherein a transverse line of weakness is formed at the junction of each pull tab and the next leading enlarged section.

4. The dispensing device of claim 2 wherein said enlarged sections are substantially circular and said pull tabs are substantially rectangular.

5. The dispensing device of claim 1 further comprising a receptacle housing said stack and having a dispensing slot formed in a wall thereof, the leading pull tab extending from the topmost enlarged section of stack projecting through said slot and being externally accessible.

6. The dispensing device of claim 5 wherein said enlarged sections are circular and said receptacle is cylindrical, said slot being formed in an end wall of said receptacle.

7. The dispensing device of claim 6 wherein said slot is transversely offset from the center of said end wall.

* * * * *